United States Patent [19]

Martinez

[11] 4,055,194

[45] Oct. 25, 1977

[54] HAIRDRESSER'S STORAGE AND DISPENSER CASE

[76] Inventor: John Martinez, 3371 W. 30th Ave., Denver, Colo. 80211

[21] Appl. No.: 695,236

[22] Filed: June 11, 1976

[51] Int. Cl.[2] ..... A45D 2/02

[52] U.S. Cl. ..... 132/39

[58] Field of Search ..... 132/39, 40, 42, 9, 83, 132/33 R; 219/222; 126/369.3, 369 X, 369.2; 312/45, 71-72

[56] References Cited

U.S. PATENT DOCUMENTS

| | | | |
|---|---|---|---|
| 3,194,620 | 7/1965 | Sauer | 312/45 |
| 3,586,010 | 6/1971 | Landen | 132/83 |
| 3,586,820 | 6/1971 | Yamanaka | 132/33 R |
| 3,646,316 | 2/1972 | Volosin | 132/39 |
| 3,754,116 | 8/1973 | Godel | 132/33 R |
| 3,948,417 | 4/1976 | McCain | 132/9 |

*Primary Examiner*—G.E. McNeill

*Attorney, Agent, or Firm*—C. B. Messenger

[57] ABSTRACT

A materials storage and dispenser case for hairdresser's use including base and cover or top components respectively providing guide channels and mating track rollers that join the components together for combined pivoting and translational movement whereby essentially loose tools and materials are securely stored in the base and top when the dispenser case is closed and can be exposed for ready access when the case is open. When in use, hair rollers or curler implements that may be of varied size are disposed in the vertically disposed top component within chutes that have guide dividers to prevent clogging of the chutes and that assure one-at-a-time dispensing of the rollers. The top is disposed in an essentially inverted horizontal position when the case is closed to prevent the escape of rollers. Separated compartments are provided in the base for the reception of additional tools, liquids, towels and other hairdresser's paraphernalia.

10 Claims, 3 Drawing Figures

HAIRDRESSER'S STORAGE AND DISPENSER CASE

BACKGROUND OF THE INVENTION

The hairdresser's art as practiced today requires a high degree of manipulative skills in addition to the required background knowledge. In order to complete an attractive hair style without tiring the customer, the operator must utilize and properly place a multiplicity of clips, curlers, pins, liquids, etc. at the same time that dexterous strokes of comb and brush are required. Since many permanent wave or hair setting solutions require completion of all operations within a limited period of time in order to assure a proper result, all required implement applications and manipulations should be completed in an efficient manner. It has previously been recognized that it is advantageous to provide storage cabinets and dispenser racks that may be positioned close to a work station so that the hairdresser will have the required materials at hand. The various types of hair rollers and curlers that may be used present a special problem, since various sizes are often used, and any and all such implements can become entangled or at least difficult to selected and hold if they are stored in open or bulk type arrangements. It is believed that a case that facilitates efficient organization of hair curlers and rollers and that will dispense such items on a one-at-a-time basis could greatly facilitate hairdressing operations.

SUMMARY OF THE INVENTION

The present invention provides a storage and dispenser case for hairdresser supplies that can be moved to a convenient position adjacent a hairdresser's work station. The dispenser case has a base and top components each of which are compartmented to receive various items. Dividers in the base provide separate open top storage compartments that can conveniently receive brushes, combs, clips, hair spray and the like. The base further provides support for a top component that is held in upright position at the rear of the base when the dispenser case is open. In its vertically disposed open position, the top, which has a plurality of partitions that separate the top into spaced channels or chutes, is adapted to receive a plurality of various sized hair curlers or rollers. A plurality of guide elements disposed within the chutes hold the rollers in axially aligned positions and further operate to prevent the jamming or entanglement of the rollers as the rollers move downwardly to a lower dispensing lip where the rollers may be removed by the operator on a one-at-a-time basis. Additional rollers may be installed through an open access at the top of the chute. Desirably, the top component is movable to a position which closes off the base compartments. In order to prevent the escape of stored rollers past the dispenser lip and through the access filler openings when the top is moved to a closed position, the top is first moved forwardly and then pivoted down and backwardly to an essentially inverted closed configuration. Guide channels and track rollers that interconnect the top and base components facilitate such desirable movement pattern.

DESCRIPTION OF THE PREFERRED EMBODIMENT

Figure 1:
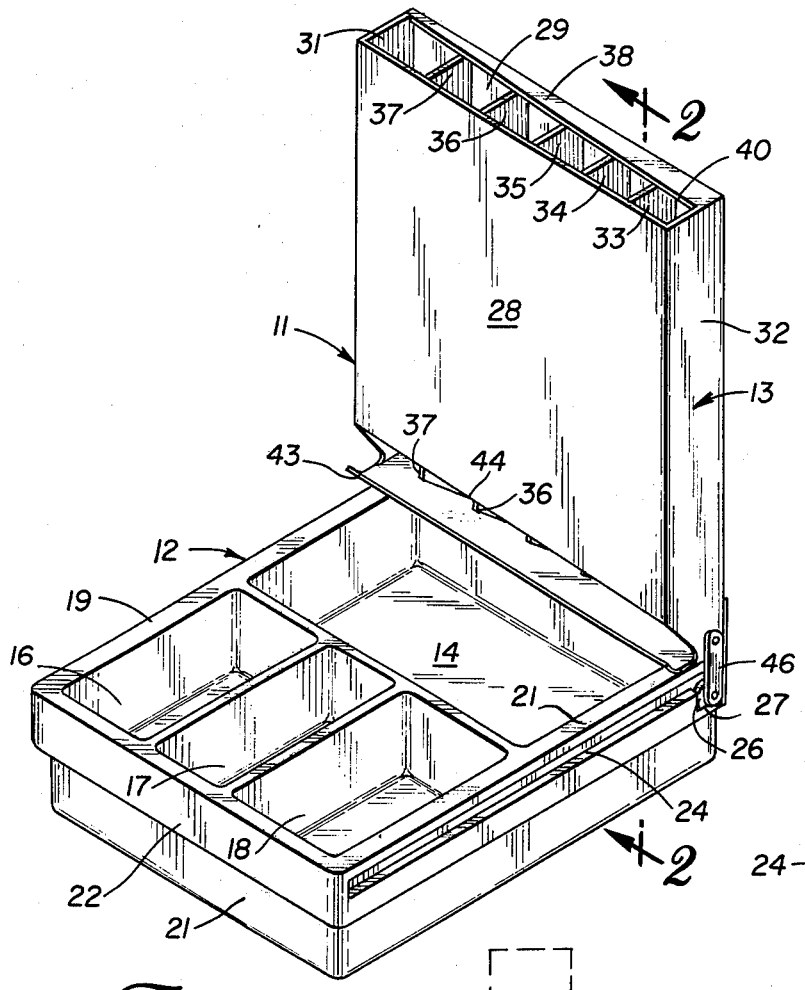
FIG. 1 is a perspective drawing showing the dispenser case in open position.

The dispenser case 11 shown in the accompanying drawings comprises a base component 12 and top or cover component 13. The interior of the base is divided to provide a plurality of separate compartments 14, 16, 17 and 18. Since the dispenser case is essentially intended for hairdresser usage, the separate compartments could be used for various supplies, tools and implements. As an example, towels, hair spray and the like could be stored in the compartment 14; clips in 16; combs and brushes in 18; and miscellaneous accessories in compartment 17.

The base component as illustrated is provided with a conventional bottom, side walls 19 and 21, a front wall 22, a back wall 23. Desirably, the upper sections of the side walls 19 and 21 are of thickened construction to provide guide channels 24 adapted to receive track rollers 26. At its rearward extent the guide channel 24 has a notch or depression 27 into which the track roller 26 falls when the top is in the open and vertically extending position as indicated in FIG. 2.

The top or cover component 13 has front and back walls 28 and 29 that are spaced apart by the end walls 31 and 32. Partitions 33, 34, 35, 36 and 37 divide the interior space between the front and back walls 28 and 29 into a plurality of separate channels or chutes that may be of varied width in order to accommodate curlers or rollers of different length. The upper ends of the separate chutes are essentially open except as closed by a tapered access baffle 38. The forward or tapered edge of such access baffle operates with the front wall 28 to limit the size of the roller that can be positioned in each chute.

Figure 2:
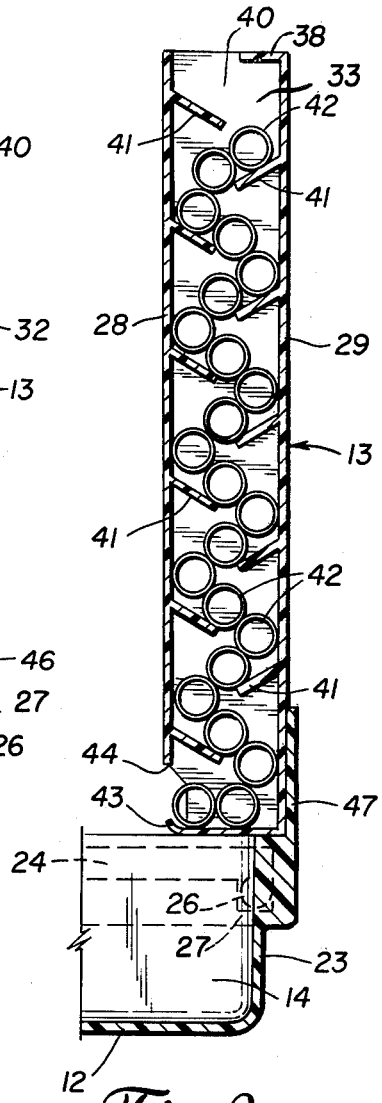
FIG. 2 is a partial cross-sectional elevation taken along line 2—2 of FIG. 1.

The interior configuration for a chute 40 is shown in FIG. 2. This chute, which is defined by the end wall 32, the first partition 33, a part of the front wall 28 and the rear wall 29, has a plurality of guides 41 that extend inwardly and downwardly from their respective support walls in a pattern that will cause any rollers 42 placed therein to move downwardly in a zigzag pattern as the rollers progress to the lower dispenser lip 43. In the course of such progressive movement, the guides 41 tend to keep the rollers separated, and, accordingly, prevent jamming thereof in any of said chutes. Necessarily, the guides 41 will be of different length and placement in each of the separate chutes so that the defined guide path for various sized rollers will be different, while serving the same purpose of preventing entanglement of the rollers that may be placed in each separate chute. For the chutes accepting larger size rollers, the guides 41 will extend a lesser distance toward the center of the defined chutes. Since the left chutes are made to accommodate larger sized rollers, the space between the dispenser lip 43 and the angularly disposed terminal lower edge 44 for the front wall 28 is of increasing size. With this arrangement a single roller will be disposed on the dispenser lip 43 at the lower end of each chute in a convenient position of access for removal by the hairdresser.

Figure 3:
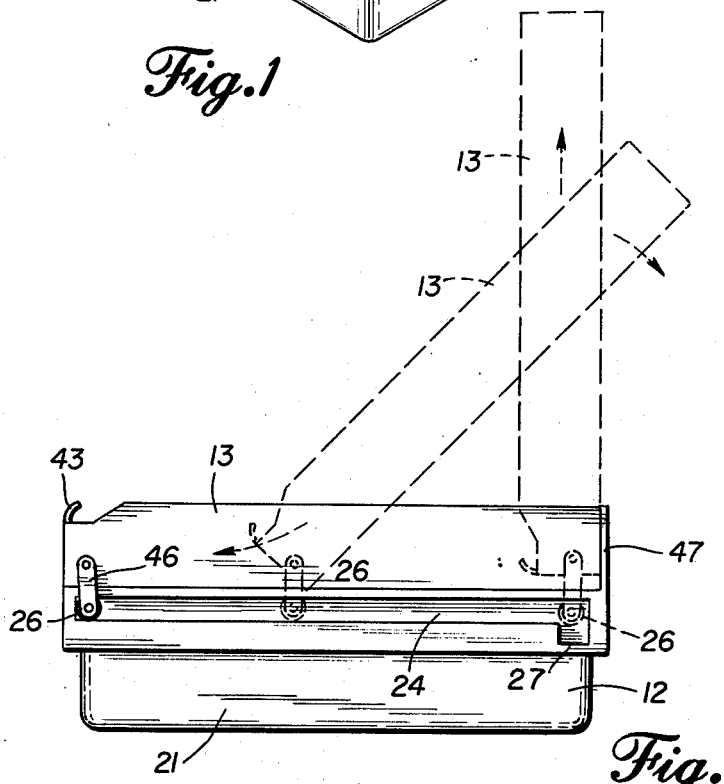
FIG. 3 is a side elevation showing alternate positions of the top cover component.

Since the ends of the separate roller storage chutes 40, etc. are open past the upper access baffle 38 and the lower dispenser lip 43, a direct downward pivoting movement of the top component 13 to close the dispenser case 11 would result in discharge or loss of rollers. To prevent this undesirable result the side guide channels 24, track rollers 26, and the connecting link 46 make it possible to move the top component 13 to a forward position adjacent the front wall 22 of the base component 12 before it is pivoted downwardly and backwardly to the case closing configuration shown in full line representation in FIG. 3. The separate alternate line representations of such Fig. additionally show the top 13 in its open vertically oriented position similar to that of FIG. 2 and in an intermediate position as it is moved toward its closed position.

When the top is in the closed position, the dispenser lip 43 will be disposed upwardly and the rollers will not escape past such lip. The tapered access baffle 38 is likewise then in an upwardly extending relationship, and rollers 42 will not escape out of the chute access openings. A rear flange 47, which is as extension of the back wall 23 for the base 12, extends above the side walls of the base component. This rear flange 47, accordingly, also serves to close off passage through the access openings for the chutes 40 to prevent loss of rollers when the case is closed.

I claim:

1. A case for storing and dispensing hair rollers and similar hairdresser's items comprising a base component having upstanding front and back and left and right side walls to provide an open top miscellaneous items storage compartments, guide elements extending from front to back along the oppositely positioned side walls of said base component, a top component of generally hollow type construction having front, back and end walls for disposition in alternate open and closed positions with respect to said base for receiving and holding said hair rollers when the top is in either position, and pivot means interengaging said guide elements and top component for attaching said base and top components together with said pivot means being translationally movable along said guide elements from back to front of said base as the top component is moved pivotally and translationally from back to front as it is moved from an upright open position above said base and at the back of said base compartment to a flat closed position wherein the back wall of said top compartment is in contact with said base for closing off access to said base compartment.

2. The storage and dispenser case as set forth in claim 1 wherein said top component additionally provides access and dispenser openings whereby hair rollers may be stored therein.

3. The storage and dispenser case as set forth in claim 2 wherein said access opening is disposed at the top of said top component, and the dispenser opening is at the bottom thereof when the top component is in its upright open position.

4. The storage and dispenser case as set forth in claim 3 wherein said access opening is at the top front and said dispenser opening is at the bottom front of said top component when the top component is in its upright open position with said access and dispenser openings, accordingly, being at the top of said top component when the top component is in its closed position.

5. The storage and dispenser case as set forth in claim 4 and further comprising a plurality of partition elements within said top component dividing the interior thereof into a plurality of separate chutes that are vertically oriented when the top component is in its open position.

6. The storage and dispenser case as set forth in claim 5 wherein said plurality of chutes are of various size adapted to receive hair rollers of varied size, and further comprising guide pieces supported within said chutes in downwardly inclined and offset chevron positions whereby rollers disposed in said chutes will be oriented in zigzag pattern.

7. The storage and dispenser case as set forth in claim 6 wherein said access and dispenser openings communicating with said chutes are of varied size for the reception and dispensing of hair rollers of varied size.

8. The storage and dispenser case as set forth in claim 4 wherein said guide elements are channels provided in the left and right side walls of said base components.

9. The storage and dispenser case as set forth in claim 8 wherein said pivot means for interengaging said channels and top component are inclusive of rollers for engagement in said channels, and link means interconnecting said rollers and top components.

10. The storage and dispenser case as set forth in claim 9 and further comprising a plurality of partition elements within said top component dividing the interior thereof into a plurality of separate chutes that are vertically oriented when the top component is in its upright open position and with said chutes being of varied size, a plurality of dividers in said base component for dividing said component to provide a plurality of storage compartments in said base, and a dispenser lip adjacent the dispenser opening for said top component, said dispenser lip extending forwardly and upwardly when the top component is in its upright open position to prevent free escape of hair rollers from said top component.

* * * * *